United States Patent [19]

Bergstein

[11] 4,032,060

[45] June 28, 1977

[54] CARTON WITH SELF-SEALING RECLOSABLE END CLOSURE

[75] Inventor: Frank D. Bergstein, Cincinnati, Ohio

[73] Assignee: Bergstein Packaging Trust, Middletown, Ohio

[22] Filed: Dec. 24, 1975

[21] Appl. No.: 644,303

[52] U.S. Cl. ..... 229/14 BA; 229/52 B
[51] Int. Cl.² ..... B65D 5/46; B65D 5/56
[58] Field of Search ..... 229/14 BA, 14 BE, 17 G, 229/39 R, 38, 52 B

[56] References Cited

UNITED STATES PATENTS

| | | | |
|---|---|---|---|
| 2,007,810 | 7/1935 | Oman | 229/52 B |
| 2,537,318 | 1/1951 | Scoble | 229/38 X |
| 2,979,247 | 4/1961 | Pellaton et al. | 229/14 BA |
| 3,036,754 | 5/1962 | Kleingers, Jr. | 229/39 R |
| 3,194,480 | 7/1965 | Maindron | 229/39 R X |
| 3,255,950 | 6/1966 | Marcouly et al. | 229/39 R X |
| 3,411,691 | 11/1968 | Whitaker et al. | 229/14 BA |
| 3,780,934 | 12/1973 | Gardner | 229/52 B |

FOREIGN PATENTS OR APPLICATIONS 965,673 8/1964 United Kingdom

*Primary Examiner*—Davis T. Moorhead
*Attorney, Agent, or Firm*—Melville, Strasser, Foster & Hoffman

[57] ABSTRACT

A rectangular carton having a self-sealing reclosable end closure which may be used with or without a liner, the end closure being adapted to lie within the confines of the carton body and having an opposing pair of vertically disposed sealing flaps biased into face-to-face contacting relation by an opposing pair of end closure flaps extending downwardly and inwardly from the carton body walls to which they are hingedly connected, the opposing pair of end closure flaps having shoulders at their opposite end edges engaged by downwardly and inwardly folded flap members hingedly connected to the remaining pair of carton body walls, the closure flaps being displaceable to open the carton by pulling upwardly on the juxtaposed sealing flaps and reclosable by juxtaposing the sealing flaps and displacing them downwardly to lie within the confines of the carton body.

9 Claims, 17 Drawing Figures

CARTON WITH SELF-SEALING RECLOSABLE END CLOSURE

BACKGROUND OF THE INVENTION

This invention relates to seal-end paperboard cartons and more particularly to cartons having a reclosable end closure by means of which the carton may be initially opened and a portion of contents dispensed, whereupon the end closure may be reclosed until it is desired to dispense additional quantities of the content.

Numerous expedients have hitherto being proposed to provide reclosable carton structure, including perforation of the end closure flaps and adjoining portions of the carton body walls to form reclosable covers, reclosable dispensing openings, and diverse types of reclosable pouring spouts. Where the contents require protection from the atmosphere, the contents are often sealed in a liner which may be opened as an incident of severing the end closure along its lines of perforation, or the end closure may be spot-sealed so that the end closure flaps may be first opened followed by the separation of the sealed end of the liner to expose the contents. This is a common expedient in cereal boxes, for example, the user having to fold the liner after use and tuck it into the top of the carton followed by the folding of the closure flaps. By and large, the reclosures are not effectively tight and the contents may be easily spilled if the cartons are knocked over. Where proofness is required, carelessness in folding the liner results in an inadequate reclosure; and in addition, the closure flaps themselves are often mutilated after initial opening and do not properly close the carton.

In contrast to the foregoing, the present invention provides an end closure which is effectively self-sealing and is essentially automatic in operation, the carton being closable and reopenable by means of simple push-pull movements.

SUMMARY OF THE INVENTION

In accordance with the present invention, the end closure comprises a first pair of opposing end closure flaps hingedly connected to a pair of the carton body walls, the first pair of end closure flaps having a width somewhat greater than one-half the width of the remaining pair of carton body walls. Sealing flaps are hingedly connected to the outermost side edges of each of the first pair of end closure flaps, the sealing flaps being adapted to be juxtaposed in face-to-face contacting relation. When the juxtaposed sealing flaps are jointly displaced downwardly to lie within the confines of the carton body, the opposing pair of end closure flaps are automatically folded downwardly and inwardly, in which position they exert sealing pressure against the sealing flaps to maintain them in tight contacting relation. When it is desired to reopen the carton, the user has but to pull upwardly on the sealing flaps, such pulling movement serving to withdraw both the sealing flaps and the opposing pair of end closure flaps from within the confines of the carton body, whereupon the sealing flaps may be separated to dispense the contents of the carton.

A pair of relatively narrow end closure flaps is hingedly connected to the remaining pair of carton body walls, the narrow closure flaps preferably being of truncated triangular configuration. These triangular flaps will be engaged and folded inwardly and downwardly by the end edges of the first pair of closure flaps as they are displaced downwardly along with the sealing flaps. Shoulders are preferably provided at the opposite ends of the first pair of end closure flaps at their juncture with the sealing flaps, the dimensioning of the parts being such that the truncated ends of the triangular closure flaps will seat on the shoulders when the sealing flaps are displaced to lie within the confines of the carton body, the triangular flaps thus serving as locking means effective to maintain the end closure in its fully closed and sealed position. The resiliency of the boxboard permits the triangular flaps to flex sufficiently to release the first pair of closure flaps as they are drawn upwardly by the sealing flaps when the carton is opened.

In order to enhance the sealing action of the sealing flaps, an extension may be provided on one of the sealing flaps adapted to be folded over the other of the sealing flaps and detachably secured in place, as by means of a locking tongue, thereby providing added protection against sifting of the contents between the sealing flaps.

While the self-sealing end closures of the present invention may be readily utilized in unlined cartons, they will find particular utility in lined cartons, the mouths of the liners being secured to the sealing flaps so that the opposite sides of the liner will be juxtaposed and effectively sealed together by the sealing flaps when in the closed position. Where the end closure includes a foldable extension on one of the sealing flaps, the mouth of the liner may be extended to coincide with the extension; with such arrangement, the mouth of the liner will be automatically folded over the opposite sealing flap along with the extension, thereby providing additional protection for the contents. It will be understood that the mouths of the liners may be sealed together as an incident of the filling and the initial closing of the carton, the seal being such that it may be readily broken and the opposite sides of the liners separated as in incident of the initial opening of the carton by the user.

The carton structures of the instant invention readily lends themselves to high speed folding and gluing operations, both in the initial assembly of the cartons and liners into flat-folded tubular cartons, and in the subsequent erection, filling and sealing of the cartons.

DESCRIPTION OF THE PREFERRED EMBODIMENTS

Figure 1:
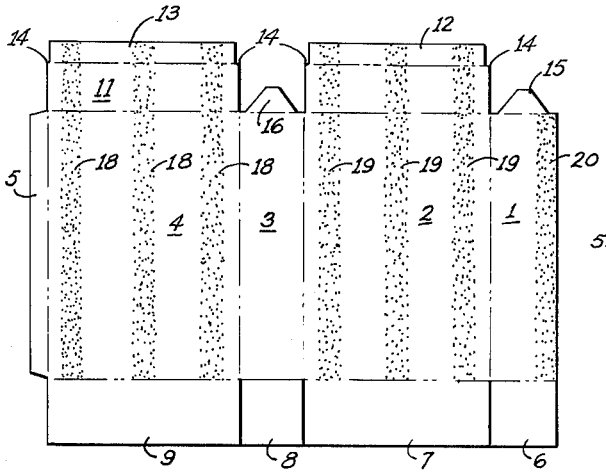
FIG. 1 is a plan view of a carton blank incorporating an end closure in accordance with the present invention.

Referring first to FIG. 1, the carton blank comprises a conventional carton body having enclosing body walls 1, 2, 3 and 4 in side by side articulation in the order named, together with an attachment flap 5. In the embodiment illustrated, the bottom closure is composed of conventional seal end flaps 6, 7, 8 and 9.

The top closure comprises a first opposing pair of closure flaps 10 and 11 hingedly connected to the uppermost ends of body walls 2 and 4, respectively, throughout their full lengths. The width of each of the closure flaps 10 and 11 is somewhat greater than one-half the width of the adjoining carton body walls 1 and 3, but less than the full width of body walls 1 and 3. Sealing flaps 12 and 13 are hingedly connected to the opposite side edges of closure flaps 10 and 11, respectively, the sealing flaps being of a length slightly less than the length of closure flaps 10 and 11 so as to define shoulders 14 at the juncture of their opposite end edges with the underlying closure flaps. Closure flaps 15 and 16, which are of truncated triangular configuration, are hingedly connected to the upper ends of body walls 1 and 3, respectively, the closure flaps 15 and 16 preferrably having a width slightly less than the width of the closure flaps 10 and 11.

If a liner is to be associated with the carton blank, adhesive strips 18 may be applied length-wise of the carton body wall 4 at spaced apart intervals, the adhesive stripes extending through in the closure flap 11 and overlying sealing flap 13. A similar set of adhesive stripes 19 is applied to body wall 2, the stripes extending through the closure flap 10 and overlying sealing flap 12. At the same time, an adhesive stripe 20 may be applied to the outermost marginal edge of body wall 1 for contact by the glue flap 5 when the carton is tubed. If desired, areas of adhesive may also be applied to body walls 1 and 3, although the liner should not be secured to these body walls in area adjacent the triangular flaps 15 and 16 where the liner should be free to deflect inwardly when the flaps 15 and 16 are infolded.

Figure 2:
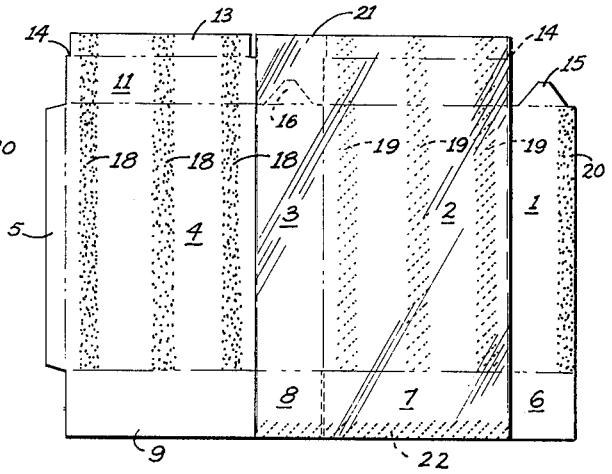
FIG. 2 is a plan view similar to FIG. 1 illustrating the application of liner to the carton blank.
Figure 3:
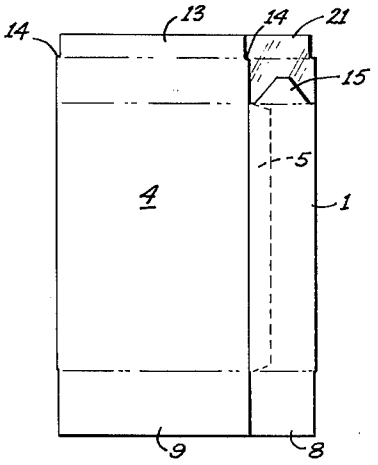
FIG. 3 illustrates the carton blank and liner of FIG. 2 in the flat-folded, knocked-down condition.

FIG. 2 shows a liner 21 juxtaposed on the body walls 2 and 3, whereupon body wall 4 is infolded, followed by the infolding of body wall 1 and the juxtaposition of the adhesive stripe 29 to the underlying glue flap 5, thereby bringing the structure to the condition illustrated in FIG. 3. The liner 21 may be in the form of a flat open-ended tube, in which event the bottom of the tube may be sealed as an incident of the erection and the filling of the carton, or the bottom of the liner may be presealed, as by means of the end seam 22.

Figure 4:
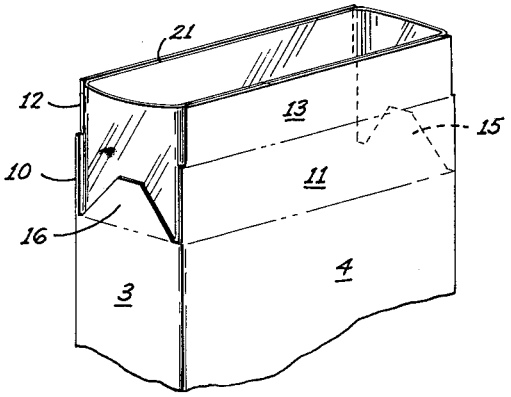
FIG. 4 is a fragmentary perspective view illustrating the carton and liner in the erected condition prior to closing and sealing of the end closure.
Figure 5:
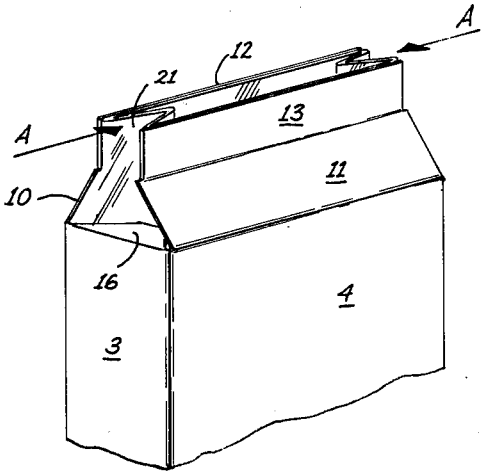
FIGS. 5, 6 and 7 are fragmentary perspective views similar to FIG. 4 illustrating successive steps in the closing and sealing of the end closure.

When the flat-folded carton structure is erected, it will initially assume the position illustrated in FIG. 4, in which the various flaps and the liner project upwardly beyond the carton body walls. The initial step in the formation of the end closure comprises the infolding of triangular flaps 15 and 16, together with the overlying opposite end portions of the liner 21. Such folding movement is indicated by the arrows A in FIG. 5, and may be readily accomplished by opposing sets of folding fingers which will engage and fold the flaps and liner ends inwardly and then retract, usually as an incident of the carton structure advancing in a path of travel with body wall 3 forming the leading end of the carton. It will be understood in the event the carton in unlined, such folding fingers, will simply fold the triangular flaps 15 and 16 inwardly in preparation for the juxtaposition of the sealing flaps 12 and 13 and infolding of closure flaps 10 and 11, which may be accomplished by various conventional folding means, such as arms or sweeps.

Figure 6:
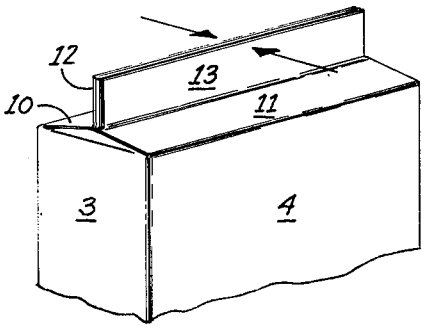
Figure 7:
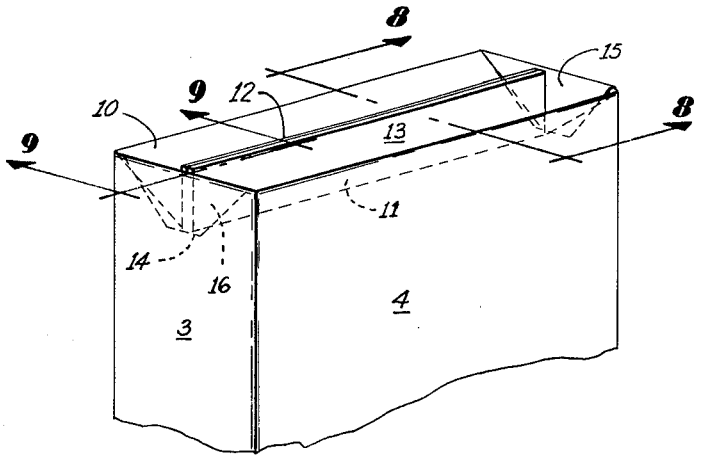
Figure 8:
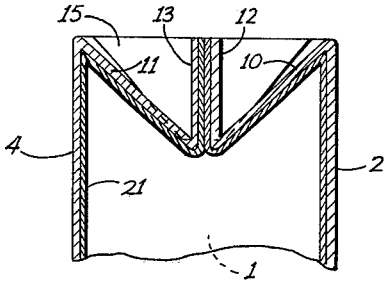
FIG. 8 is a vertical sectional view taken along the line 8—8 of FIG. 7 illustrating the end closure in the fully closed position.
Figure 9:
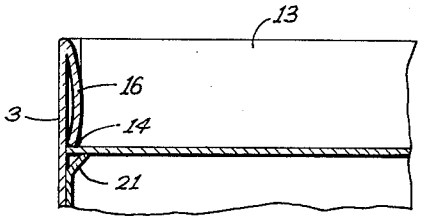
FIG. 9 is a vertical sectional view taken along the line 9—9 of FIG. 7 also illustrating the end closure in the fully closed position.

FIG. 6 illustrates the end closure with the sealing flaps 12 and 13 juxtaposed and the opposing closure flaps 10 and 11 folded to a substantially horizontal position. It will be remembered, however, that each of the flaps 10 and 11 is somewhat wider than one-half the width of the adjacent body walls; consequently, as the sealing flaps 12 and 13 are moved downwardly, the opposing body walls 2 and 4 will be flexed outwardly to accomodate the closure flaps 10 and 11 as they pass through a horizontal position and enter the mouth of the carton. The dimensioning of the flaps will preferably be such that they will reach the fully closed position when the uppermost edges of the sealing flaps 12 and 13 coincide with the uppermost edges of the carton body walls; thus, the entire end closure will lie within the confines of the carton body walls, as illustrated in FIG. 7. When in this position, the opposing closure flaps 10 and 11 will be inclined downwardly and inwardly in the manner best seen in FIG. 8, and it will be evident that the natural tendency of the folded flaps will be to unfold, due to the resiliency of the boxboard, and such tendency to unfold serves to bias the juxtaposed sealing flaps 12 and 13 into tight engagement with the liner clamped therebetween. In addition, when the closure flaps 10 and 11 reach the fully closed position, the shoulders 14 at their opposite ends will engage beneath the truncated end edges of the infolded triangular flaps 15 and 16, thereby locking the closure flaps in the closed position, in the manner illustrated in FIG. 9. When it is desired to reopen the end closure, upward movement of the sealing flaps 12 and 13 will cause opposing flaps 10 and 11 to move upwardly, and in so doing the triangular flaps 15 and 16 will also move upwardly and will flex sufficiently to release the shoulders 14 as the closure flaps move upwardly.

Figure 10:
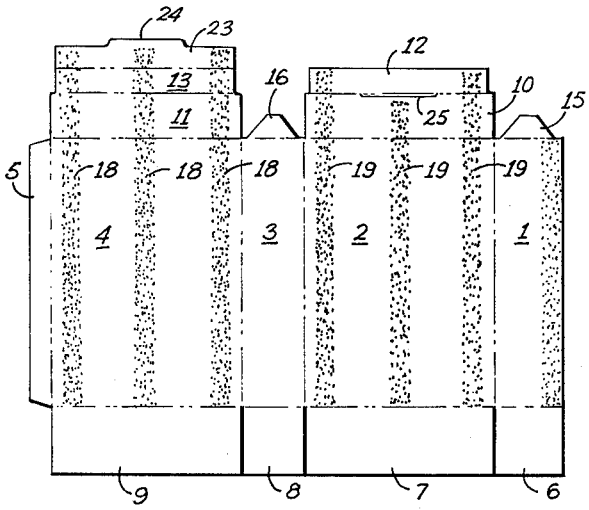
FIG. 10 is a partial plan view of a carton blank embodying a modified end closure in accordance with the invention.

In the modification of the invention illustrated in FIG. 10, wherein like parts have given like reference numerals, the sealing flap 13 is provided with a hinged extension 23 having a shallow tongue 24 along its uppermost edge. A tongue receiving slot 25 is provided in the opposing closure flap 10 at its juncture with sealing flap 12. It will be noted that the adhesive stripes 18 extend through the extension 23, but preferably the center stripe will terminate just short of the tongue 24. Similarly, the centermost adhesive stripe 19 will preferably terminate just short of the slot 25, although if desired an area adhesive may be centrally disposed on sealing flap 12 above the slot 25.

Figure 11:
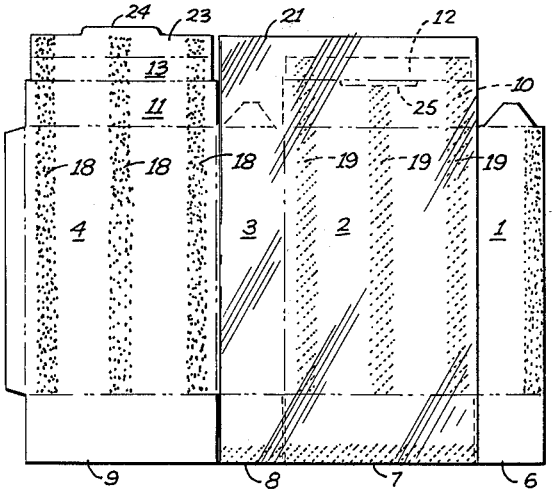
FIG. 11 is a partial plan view similar to FIG. 10 illustrating the association of a liner with the blank of FIG. 10.

FIG. 11 illustrates the juxtaposition of liner 21 on the flat carton blank, and it will be noted that the length of the liner is such that its uppermost end edge coincides with the uppermost edge of extension 23, but preferably short of tongue 24. The liner also projects upwardly beyond the uppermost edge of opposing sealing flap 12.

Figure 12:
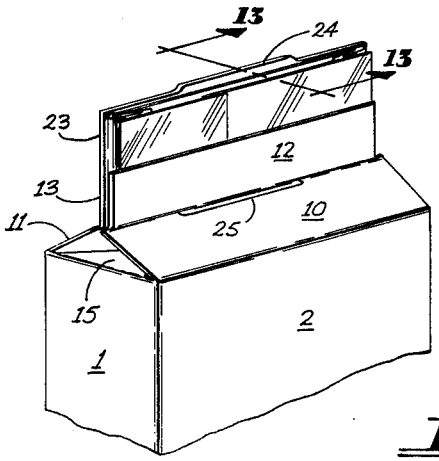
FIG. 12 is a fragmentary perspective view illustrating the end closure of FIGS. 10 and 11 in partially erected condition.
Figure 13:
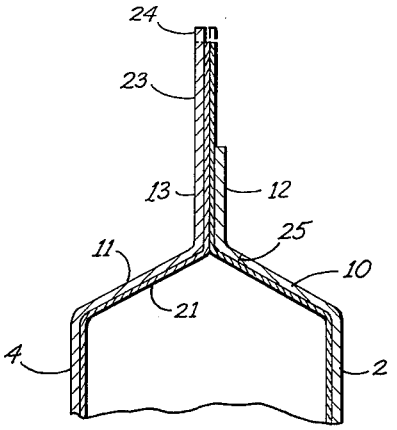
FIG. 13 is a vertical sectional taken along the line 13 of FIG. 12.
Figure 14:
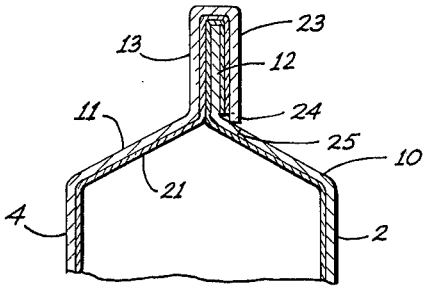
FIGS. 14 and 15 are vertical sectional views similar to FIG. 13 illustrating successive steps in the closing of the modified end closure.
Figure 15:
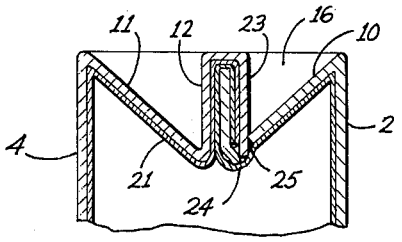

When the carton structure of FIGS. 10 and 11 is erected and the opposing sealing flaps 12 and 13 juxtaposed, the parts will assume the condition illustrated in FIG. 12, wherein it will be seen that the extension 23 projects upwardly from the sealing flap 13 and has the adjacent side of liner 21 secured thereto. The opposite side of the liner projects upwardly beyond the opposing sealing flap 12 to which it is also secured. This posiion of parts is also illustrated in FIG. 13. Thereafter, the extension 23 together with the mouth of the liner 21 adhered thereto is folded over the uppermost edge of the opposing sealing flap 12, with the tongue 24 engaged in slot 25, the parts thus assuming the position illustrated in FIG. 14, wherein it will be seen that the liner is not only tightly engaged between the sealing flaps 12 and 13, but additionally is engaged between the sealing flap 12 and the folded over extension 23, thereby forming an extremely tight seal. Thereafter, the closure flaps are displaced downwardly to the fully closed position illustrated in FIG. 15, in which the triangular end closure flaps 15 and 16 will have engaged the shoulders 14 to lock the assembly in the closed position. The carton will be opened in the same manner as previously described in connection with the embodiment of FIGS. 1–9, except that the extension 23 will be unfolded prior to expanding the mouth of the liner by moving the sealing flaps outwardly relative to each other.

Figure 16:
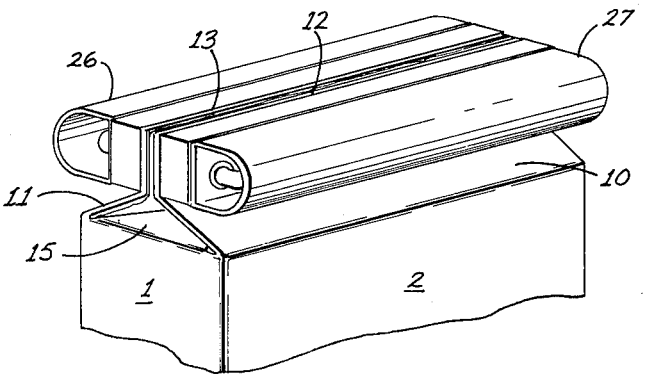
FIG. 16 is a fragmentary perspective view illustrating the sealing of the liner mouth as an incident of the closing of the end closure.

As previously indicated, the sealing flaps or the liner may be initially adhered together, as by means of a reactivatable adhesive applied to their inner surfaces, the adhesive being reactivated as an incident of initially juxtaposing the sealing flaps. Thus, as illustrated in FIG. 16, heated sealing bars 26 and 27 may be pressed against the opposite side of the flaps 12 and 13 to effect the desired seal. Similarly, where a liner is employed, a suitable adhesive material may be applied to the inner surfaces of the liner in the area of its mouth, or the liner material itself may be chosen to have heat sealing properties. Preferably, the nature of the sealing material will be chosen so that it may be readily separated, as by inserting a knife blade or similar objects between the sealed areas. In cases where the end closure includes a foldable extension on the upper edge of one of the sealing flaps, the extension, when folded, can be spot glued to the outer surface of the sealing flap over which it is folded, thereby providing a sealed closure which can be readily broken to open the carton.

Figure 17:
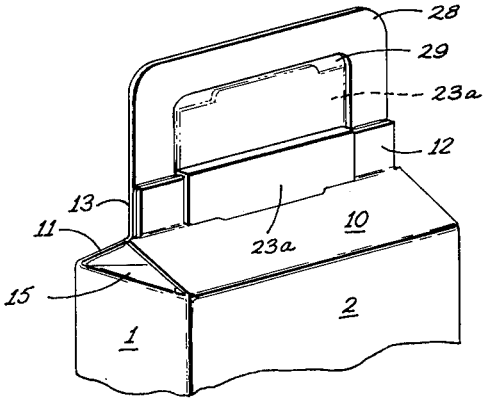
FIG. 17 is a fragmentary perspective view of a modification incorporating a carrying handle.

FIG. 17 illustrates a further modification of the invention wherein either for both of the sealing flaps 12 and 13 may terminate upwardly in an integral carrying handle 28 having a hand-hole opening 29. In this event, one of the sealing flaps may be provided with a hinged extension 23a of a width equal to the width of hand-hole opening 29, the extension being foldable over the upper edge of the other of the sealing flaps from the position shown in dotted lines to the position shown in solid lines to form a tight seal. Such handle construction will be particularly suited for the packaging of relatively light weight materials, such as pop-corn, snack and the like.

As should now be evident, the instant invention provides an essentially automatic reclosable end closure which effectively seals the carton each time it is closed. The end closure is easily closed and opened, and when closed provides a tight closure which is not subject to being dislodged even though the carton might be knocked over or dropped.

It is to be understood that modifications may be made in the invention without departing from its true spirit and scope. Various modifications have already been setforth and others will undoubtedly occur to the worker in the art upon reading this specification. For example, although it is preferred to provide triangular closure flaps on the remaining pair of body walls, such flaps may be omitted if desird, particularly where the carton is lined, the opposing closure flaps and sealing flaps (if made the same length as the closure flaps) being held in the closed position by the abutting engagement of their end edges with the adjoining walls of the carton. Normally, a reclosable end closure in accordance with the invention will be provided at only one end of the carton, the other end being closed and sealed by conventional end closure flaps, but it will be readily evident that both ends of the carton may be provided with end closures in accordance with the invention. While the invention has been described in connection with unlined cartons and with cartons having liners applied to the flat blanks before tubing, the carton blanks may be lined in other ways, as by forming the liner around a mandrel about which the carton blank is subsequently folded, or the liner may be separately formed and inserted in the carton after it has been tubed or after it has been erected. Accordingly, it is not intended that the invention be limited other than in the manner set forth in the claims which follow.

The embodiments of the invention in which an exclusive property or privilege is claimed are defined as follows:

1. In a rectangular carton having opposing side and end walls forming a carton body, a self-sealing reclosable end closure comprising a pair of opposing end closure flaps hingedly connected to the end edges of the carton side walls, said end closure flaps having a width somewhat greater than one-half the width of the carton end walls, a pair of mating sealing flaps hingedly connected to the outermost side edges of said pair of end closure flaps, a flap extension hingedly connected to the outer side edge of one of said sealing flaps, and a tubular liner in said carton body, the mouth of said liner projecting from said carton body to overlie said flap extension, the mouth of said liner having its opposite sides secured to said sealing flaps, said sealing flaps being juxtaposed in face-to-face parallel relation to the carton side walls with portions of the liner mouth sandwiched therebetween, said sealing flaps and the projecting end of the liner being jointly displaceable downwwardly to lie within the confines of the carton body and with said opposing pair of closure flaps extending downwardly and inwardly within the carton to bias the sealing flaps and the portions of the liner mouth secured thereto into engagement with each other, said flap extension and the portion of the liner mouth overlying said flap extension being jointly foldable over the upper edge of the other of said sealing flaps, and attachment means for securing said flap extension in its folded position.

2. The reclosable end closure claimed in claim 1 including a pair of narrow end closure flaps hingedly connected to the end edges of the carton end walls, said last named closure flaps being displaceable inwardly to abut against the end edges of the said pair of opposing end closure flaps and said sealing flaps.

3. The reclosable end closure claimed in claim 2 including locking means for securing the opposite ends of said opposing pair of end closure flaps to said narrow end closure flaps.

4. The reclosable end closure claimed in claim 3 wherein said locking means comprise shoulders formed at the juncture of said opposing pair of end closure flaps and said sealing flaps, and wherein said shoulders are engageable by end edges of said narrow end closure flaps.

5. The reclosable end closure claimed in claim 4 wherein said narrow end closure flaps are of truncated triangular configuration.

6. The reclosable end closure claimed in claim 1 wherein said attachment means comprises a tongue on the outer side edge of said extension and a tongue receiving slot in the end closure flap connected to the sealing flap over which said extension is folded.

7. A self-sealing end closure for a rectangular carton having opposing side and end walls, said end closure comprising an opposing pair of end closure flaps hingedly connected to the ends of the carton side walls, said opposing closure flaps having a width less than the full width but greater than one-half the width of the carton end walls, a pair of mating sealing flaps hingedly connected to the uppermost side edges of said opposing pair of end closure flaps, narrow end closure flaps of truncated triangular configuration hingedly connected to the ends of the carton end walls, and shoulders formed at the opposite ends of said opposing pair of end closure flaps at their juncture with said sealing flaps, said sealing flaps being juxtaposed in face-to-face contact centrally between and parallel to the opposing carton side walls and lying within the confines of the carton body with said opposing pair of closure flaps projecting downwardly and inwardly within the carton and acting to resilient bias the sealing flaps into engagement with each other, said narrow triangular flaps being infolded within the carton body with their truncated end edges seated on the shoulders at the end edges of said opposing pair of end closure flaps.

8. The self-sealing end closure claimed in claim 1 including a tubular liner for the carton, said liner having its opposite side edges secured to said flap sealing flaps.

9. The self-sealing end closure claimed in claim 8 including a flap extension hingedly connectd to the outer side edge of one of said sealing flaps, said extension being folded over the other said sealing flaps, and attachment means for securing said extension in its folded position.

* * * * *